United States Patent [19]

Cox

[11] Patent Number: 4,712,455

[45] Date of Patent: Dec. 15, 1987

[54] SLIDING JAW WRENCH

[76] Inventor: Terrence D. Cox, P.O. Box 222, Olney, Ill. 62450

[21] Appl. No.: 835,260

[22] Filed: Mar. 3, 1986

Related U.S. Application Data

[63] Continuation-in-part of Ser. No. 622,622, Jun. 20, 1984, Pat. No. 4,580,468.

[51] Int. Cl.[4] ..... B25B 13/14; B25B 13/18

[52] U.S. Cl. ..... 81/141; 81/138; 81/139; 81/143; 81/145

[58] Field of Search ..... 81/129, 129.5, 132–134, 81/138–139, 141–145, 411, 328, 356, 185.1, 93–94, 100–101, 106, 109, 358

[56] References Cited

U.S. PATENT DOCUMENTS

| | | | |
|---|---|---|---|
| 468,601 | 2/1892 | Gorsuch | 81/106 |
| 643,632 | 2/1900 | Cooper | 81/129.5 X |
| 761,868 | 6/1904 | Atkinson | 81/139 |
| 794,067 | 7/1905 | Ackerman | 81/132 |
| 1,471,413 | 10/1923 | Palmeter | 81/145 |
| 1,643,002 | 9/1927 | Beszczak | 81/134 |

FOREIGN PATENT DOCUMENTS

| | | | |
|---|---|---|---|
| 942047 | 1/1949 | France | 81/141 |

*Primary Examiner*—Frederick R. Schmidt
*Assistant Examiner*—Debra S. Meislin
*Attorney, Agent, or Firm*—Fleit, Jacobson, Cohn & Price

[57] ABSTRACT

A sliding jaw pipe wrench has a jaw adjustment mechanism comprising a longitudinally extending series of transverse recesses formed in one surface of a elongate shank on which the movable jaw of the wrench is formed. The shank is received in a retaining pocket in the wrench handle on which the stationary jaw is formed, and the handle includes a transverse locking pin for engagement in, and disengagement from the respective recesses to retain the movable jaw in position when engaged in a recess and allow the shank to be moved to adjust the jaws when disengaged from the recesses. The locking pin is operated by a trigger-like lever pivoted on the handle and connected to a locking pin by an elongate actuating rod. The wrench is provided with a fine adjustment mechanism in the form of a stud threaded transversely through an aperture in the handle so that the inner end of the stud can be tightened against an edge of the shank opposite the recesses. The fine adjustment mechanism takes up slack in the movable jaw when gripping a pipe.

9 Claims, 2 Drawing Figures

SLIDING JAW WRENCH

CROSS-REFERENCE TO RELATED APPLICATION

This application is a continuation-in-part of application Ser. No. 622,622, filed June 20, 1984, now U.S. Pat. No. 4,580,468 issued Apr. 8, 1986 and the disclosure of which is expressly incorporated herein by reference.

BACKGROUND OF THE INVENTION

This invention relates to sliding jaw wrenches, particularly pipe wrenches in which a movable jaw has a degree of freedom to rock or float relative to a stationary jaw, and the jaws are relatively inclined in order to grip around a pipe or the like.

In wrenches of the sliding jaw-type, the movable jaw commonly is formed on a elongate shank which is mounted for lengthwise movement, to adjust the jaw opening, on a wrench handle, which is formed with the stationary jaw, and a screw mechanism with a rotary actuator is commonly provided between the shank and the handle to effect adjustable movements of the movable jaw. In such wrenches, both hands may be needed to adjust the jaws, and the screw mechanism may be difficult to operate should dirt get in the threads or should the operator's fingers be stiff or slippery.

The parent application provides a sliding jaw wrench having an alternative type of adjustment mechanism which is simpler to operate, and not as subject to the difficulties outlined above. Thus, the parent application discloses a sliding jaw wrench comprising a wrench handle, a stationary jaw on the wrench handle, an elongate shank formed with a movable jaw, the shank being mounted for movement in a pocket formed in the handle to adjust the degree of opening of the jaws, a longitudinal series of transverse recesses formed along one edge of the shank, a transverse mounting pin mounted in the handle for movement into and out of engagement with respective ones of the recesses for respectively retaining the shank in position and releasing the shank for adjustment of the jaws, an actuating assembly associated with the handle for moving the locking pin, and a nipple formed on a wall of the handle defining the pocket for engaging an opposite edge of the shank and for providing rocking of the shank in the pocket facilitating gripping of the workpiece between the jaws.

A wrench in accordance with the parent application can be adjusted with one hand, without a user having to release his or her grip on the wrench handle simply by applying thumb or finger pressure on a sprung lever forming part of the actuator assembly, and flicking or otherwise moving the movable jaw to the required position. However, in a wrench of this type, since the degree of opening of the jaws is dependent on the engagement of the locking pin in a selected recess, and since there are spaces between the recesses, adjustment of the jaws is not infinite, but is incremental. A situation may therefore arise in which when tightening the wrench onto an article such as a pipe, neither one of a pair of adjacent recesses gives the precise degree of jaw opening required for an absolutely positive and optimum fit on the pipe.

It is an object of the present invention to provide, in a sliding jaw-type wrench having incremental adjustment means for changing the degree of jaw opening, a fine adjustment mechanism whereby a more accurate fit of the wrench jaws on a object to be gripped can be obtained where such fit would otherwise correspond with a jaw opening position which is between a pair of incremental jaw movements.

SUMMARY OF THE INVENTION

Primarily, the present invention provides a sliding jaw wrench as disclosed in the parent application and which further includes a fine adjustment mechanism for accurately adjusting the degree of jaw opening and tightening of same onto an article being gripped so as to compensate for degrees of jaw opening corresponding to positions of the locking pin between a pair of adjacent recesses on the elongate shank formed with the movable jaw. In a preferred form of the invention, the fine adjustment mechanism comprises a threaded stud inserted through a correspondingly threaded hole in the wrench handle opening substantially transversely into said pocket adjacent the nipple so that the inner end of the stud may engage the edge of the shank opposite the recesses whereby a degree of slack in the movable jaw when gripping an article may be taken up by tightening the threaded stud against said edge of the shank. The threaded stud may extend from an outer surface of the handle and be provided with a knurled or similarly formed head so that it may be turned manually.

The threaded stud provides a simple and convenient form of fine adjustment mechanism in a wrench as described and also is useful when the wrench is to be used on a pipe in the manner of a vise. While the fine adjustment mechanism of the invention is particularly applicable to wrenches of the particular type disclosed in the parent application, it is also considered useful in similar sliding jaw wrenches having incremental rather than infinite adjustment means for the degree of jaw opening.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
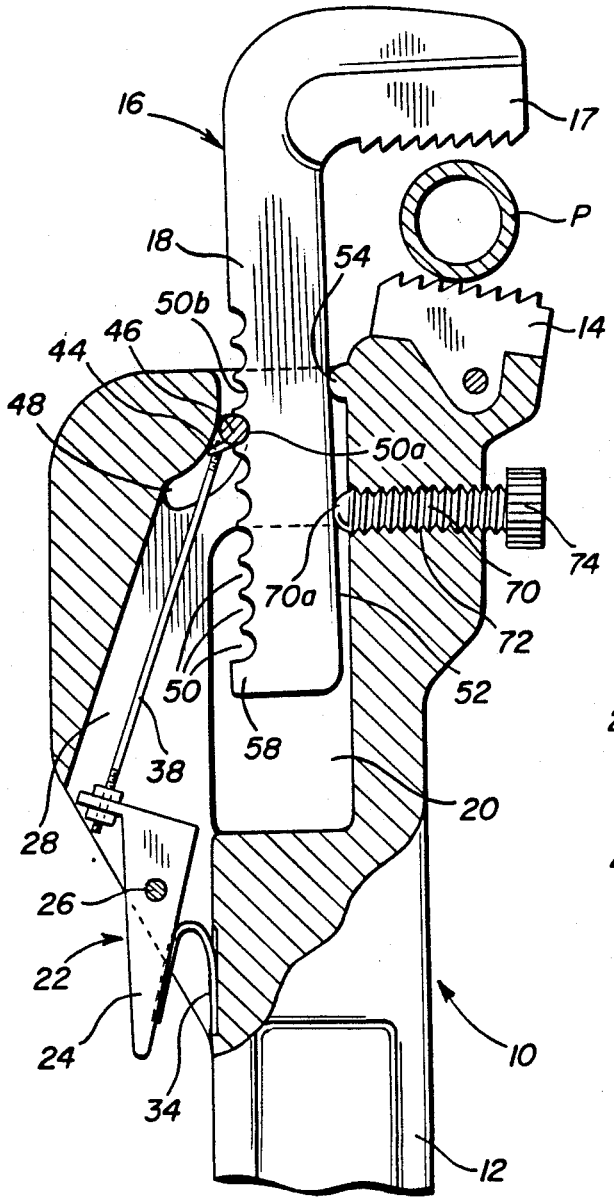
FIG. 1 is a cross-sectional view through the operative end of a sliding jaw wrench with the jaws shown in a position prior to fine adjustment thereof onto a pipe.

A sliding jaw wrench 10 generally is of like construction to the wrench shown and described in FIGS. 1–7 of the parent application to which reference may be made for a more detailed description of the wrench construction and operation.

Wrench 10 has an elongate handle 12, only the upper operative end of which is shown in the present drawings, the handle being provided at its upper end with a stationary hardened steel serated jaw insert 14. A movable jaw member 16 has a movable jaw 17 formed at the end of an elongate shank 18, which is received in a pocket 20 in the upper portion of handle 12, and a releasable adjustment mechanism, generally indicated by reference 22, is provided for retaining the movable jaw member 16 in selected position determining the degree of opening of the wrench jaws.

The adjustment mechanism includes a trigger-like lever 24 pivotably mounted on a pivot pin 26 spanning opposed walls of a slotted portion of the handle, only one wall 28 of which is seen in the drawings, the lever 24 being urged outwardly of the handle by a yoke-like spring 34 with its respective arms seated in respective recesses in the side of the handle and the side of the lever member. At its upper end, the other end of the lever member has a slotted extension with arms which receive the lower end of an elongate rod 38 forming a further element of the jaw adjustment mechanism. The attachment of the rod 38 to the lever 24 is described in full in the parent application. At its upper end, rod 38 is threaded into a tongue 44 on the back of a transverse locking pin 46 which rides in arcuate slots 48 formed in the respective sidewalls of the handle.

Along its rear edge, shank 18 is provided with a longitudinal series of pin-receiving recesses 50 and the configuration of the adjustment mechanism is such that lever 24 being urged outwardly by spring 34 urges pin 46 toward the top of slots 48 into a position in which the central portion of the pin is received in one of the recesses 50 to lock the movable jaw in longitudinally adjusted position relative to the stationary jaw.

Forward edge 52 of shank 18 engages a nipple 54 on the interior of the handle, so that the movable jaw member has a degree of freedom to rock about the nipple 54 and pin 46 to facilitate gripping around the pipe. Also, it will be noted that the jaws are relatively inclined, as is customary in pipe wrenches. When adjustment of the degree of jaw openings required, lever member 24 depressed by thumb or finger pressure against the force of spring 34 causing pin 46 to be pulled down slots 48 by rod 38 and out of engagement with the respective shank recess 50, thus releasing the shank and allowing the movable jaw to be flicked in the hand or otherwise moved to the required adjusted position. A projection 58 on the bottom of shank 18 adjacent the endmost recess 50 which defines the maximum jaw opening, prevents the shank from moving out of the handle past pin 46.

Figure 2:
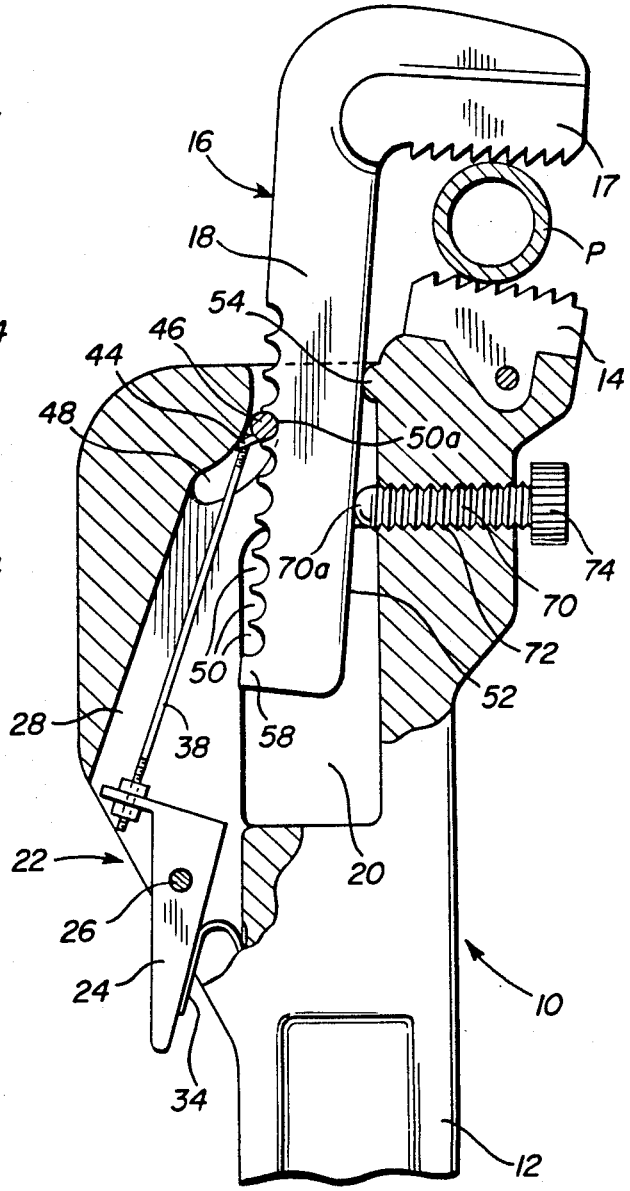
FIG. 2 is similar to FIG. 1 with the jaws shown gripping the pipe after fine adjustment thereof.

As shown in FIG. 1 of the drawings, the locking pin 46 has been engaged in a particular recess **50*a* which is the closest fit that can be obtained in relation to a pipe P which is to be gripped between the wrench jaws. In this position, it is seen that a small gap (which may be exaggerated in the drawings) is still present between the pipe and the movable jaw 17. However, the situation may be such that the pipe may be too large for the shank 18 to be adjusted inwardly and bring the next recess 50*b* into engagement with pin 46. Therefore, in accordance with the invention, the wrench is provided with a fine adjustment mechanism in the form of a threaded stud 70 which is threaded a correspondingly threaded hole 72 formed at the upper end of the handle, so that the hole opens transversely into pocket 20 below the nipple 54. The inner end 70*a* of the threaded stud can thus be brought into engagement with front edge 52 of shank 18. The stud may project from the handle and have a knurled or like head 74 for manual adjustment. Normally, the stud is retracted. However, should a situation such as described in relation to FIG. 1 be encountered where there is a gap between an article to be gripped and the movable jaw effectively due to the incremental nature of the jaw adjustment and the presence of a land between the respective recesses 50, the stud can be tightened against shank 18 effecting pivotal or rocking movement of the shank about the nipple 54 and tightening of jaw 17 onto the pipe P as shown in FIG. 2. Accordingly, in this manner, the slack which may be created due to the incremental degree of jaw adjustment is effectively taken up. To release the pipe, stud 70** is unscrewed.

The fine adjustment mechanism above described is useful, for example, in gripping a pipe in the manner of a vise. This is particularly useful, for example, where a pair of threaded pipe lengths with a stiff connection therebetween need to be separated and an operator needs to use his whole force on a wrench gripping one of the pipe sections. In this application, a second wrench having a vise-like grip as provided by the fine adjustment mechanism can be clamped onto the other pipe section and used as a lever or reaction member against a support surface such as the ground. Without means for providing a vise-like grip on the second pipe section, a conventional wrench would tend to slip or tilt away from the second pipe section if unattended.

While a fine adjustment mechanism of the type described is particularly applicable to a pipe wrench having an adjustment mechanism of the type disclosed in the parent application, it is also considered useful in sliding jaw wrenches having other forms of incremental jaw adjustment.

Reverting to the specific embodiment herein described, it will noted, looked at in the alternative, that the effect of using the adjustment stud 70 in the manner described by tightening onto shank 18 effectively decreases the amount of rocking movement of the shank afforded by the nipple 54.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sliding jaw wrench comprising a wrench handle, a stationary jaw on the handle, a movable jaw having an elongate shank extending therefrom, the shank being mounted for movement in a pocket formed in the handle to adjust the degree of opening of the jaws, means for providing incremental movement of the shank relative to the handle for incrementally adjusting the spacing between the jaws, means for releasably retaining the shank in selected incrementally adjusted positions relative to the handle, means permitting a degree of rocking movement of the shank in said pocket in said incrementally adjusted positions, and fine adjustment associated with the handle for selectively taking up slack in the movable jaw by moving the movable jaw toward the stationary jaw and reducing the amount of rocking movement available to the shank in said adjusted positions.

2. The invention as defined in claim 1 wherein the means for permitting a degree of rocking movement of the shank in said pocket includes a nipple on a wall of the handle defining the pocket and which engages a leading edge of the shank, the fine adjustment means comprising a threaded stud threaded in a hole in the handle opening into the pocket through said wall whereby an inner end of the stud can be tightened against said edge of the shank to reduce the degree of rocking movement of the shank permitted by the nipple.

3. The invention as defined in claim 2 wherein the means for providing incremental movement of the shank includes a longitudinal series of recesses formed in a trailing edge of the shank, and the means for releasably retaining the shank comprises a locking pin in the handle for movement into and out of engagement into a selective one of said recesses, and actuating means associated with the handle for moving the locking pin.

4. The invention as defined in claim 2 wherein the stud protrudes from the handle and terminates in a head for manually rotating same.

5. A sliding jaw wrench comprising a wrench handle, a stationary jaw on the handle, a movable jaw having an elongate shank extending therefrom, the shank being mounted for movement in a pocket formed in the handle to adjust the degree of opening of the jaws, a longitudinal series of recesses formed along one edge of the shank, a locking pin mounted in the handle for movement into and out of engagement with a respective one of said recesses for respectively retaining the shank in position and releasing the shank for adjustment of the jaws, actuating means associated with the handle for moving the locking pin, a nipple formed on a wall of a handle defining the pocket for engaging an opposite edge of the shank and for permitting a degree of rocking movement of the shank in the pocket facilitating gripping of a workpiece between the jaws, and fine adjustment means associated with the handle for selective cooperation with the shank and reduction of the degree of rocking movement of the shank permitted by the nipple by moving the movable jaw toward the stationary jaw.

6. The invention as defined in claim 5 wherein the fine adjustment means comprises a threaded stud threaded in a hole in the handle with an inner end for tightening against said opposite edge of the shank adjacent the nipple.

7. The invention as defined in claim 6 wherein the stud has an outer end projecting from the handle with a manual gripping head.

8. A sliding jaw wrench comprising a wrench handle, a stationary jaw on the handle, a movable jaw having an elongate shank extending therefrom, the shank being mounted for movement in a pocket formed in the handle to adjust the degree of opening of the jaws, a longitudinal series of recesses formed along one edge of the shank, a locking pin mounted in the handle for movement into and out of engagement with a respective one of said recesses for respectively retaining the shank in position and releasing the shank for adjustment of the jaws, actuating means associated with the handle for moving the locking pin, a nipple formed on a wall of the handle defining the pocket for engaging an opposite edge of the shank and for permitting a degree of rocking movement of the shank in the pocket facilitating gripping of a workpiece between the jaws, and a threaded stud in the handle having an inner end for selectively tightening against said opposite edge of the shank and reducing the degree of rocking movement thereof permitted by the nipple by moving the movable jaw toward the stationary jaw.

9. The invention as defined in claim 8 wherein the stud has an outer end projecting from the handle with a manual gripping head formed thereon.

* * * * *